US005535521A

United States Patent [19]

Alcorn

[11] Patent Number: 5,535,521

[45] Date of Patent: Jul. 16, 1996

[54] CHAIN SAW GUARD

[76] Inventor: David M. Alcorn, 122 Alcorn Loop Rd., Ruffin, N.C. 27326

[21] Appl. No.: 443,092

[22] Filed: May 17, 1995

Related U.S. Application Data

[63] Continuation of Ser. No. 191,484, Feb. 4, 1994, abandoned.

[51] Int. Cl.[6] ..... B27B 17/02

[52] U.S. Cl. ..... 30/382; 30/286

[58] Field of Search ..... 30/382, 286, 123.4, 30/381

[56] References Cited

U.S. PATENT DOCUMENTS

| | | | |
|---|---|---|---|
| 2,638,944 | 5/1953 | Woleslagle . | |
| 4,143,460 | 3/1979 | Shean | 30/382 |
| 4,272,889 | 6/1981 | Scott et al. | 30/382 X |
| 4,317,285 | 3/1982 | Graham | 30/371 |
| 4,524,519 | 6/1985 | Muehling | 30/382 |
| 4,945,641 | 8/1990 | Miller et al. | 30/382 |
| 5,156,156 | 10/1992 | Ruzich | 30/382 |
| 5,269,064 | 12/1993 | Green et al. | 30/382 |
| 5,435,065 | 7/1995 | Raczykowski | 30/382 |

*Primary Examiner*—Kenneth E. Peterson
*Assistant Examiner*—Sean A. Pryor

[57] ABSTRACT

A guard for a portable chain saw is provided that will prevent injury from saw "kick-back" and will assist in preventing injuries from a moving saw blade. The chain saw guard can be easily adapted to conventional chain saws by the use of ordinary hand tools and includes a motor housing bracket and blade bridge, which is slidably directed along the saw blade by a pair of attached rods that are slidably mounted to the housing bracket. A slotted blade guide bar receives a bridge guide to stabilize a vertical bridge component, and a resilient spring returns the bridge to its original, extended posture along the blade.

12 Claims, 3 Drawing Sheets

CHAIN SAW GUARD

This is a continuation of parent application Ser. No. 08/191,484 filed Feb. 4, 1994, now abandoned.

BACKGROUND OF THE INVENTION

1. Field of the Invention

The invention herein pertains to devices to prevent injury from "kick-back" from portable chain saws and specifically to a guard for a chain saw blade.

2. Description of the Prior Art and Objectives of the Invention

Chain saw usage by relatively unskilled personnel has increased in recent years and this has increased the number of accidents by those using portable chain saws. Both gasoline powered and electric chain saws have become increasingly popular for surburban dwellers having relatively little experience in their use. Exposed saw cutting chains are dangerous whether running or idle, and inexperienced users cutting brush or trimming the tops of trees or small limbs sometimes come in contact with the upper part of the cutting chain. Also, while cutting, the cutting chain can become wedged or lodged in a tree trunk or limb, which stops the cutting chain movement and causes it to react by "kicking-back" violently. Thus, to prevent the cutting chain and blade from binding and to prevent kick-back, the present invention was conceived and one of its objectives is to provide a chain saw blade guard that will protect the cutting chain and reduce the incidence of kick-back.

It is still another objective of the present invention to provide a chain saw guard that can be readily attached to conventional chain saws with simple hand tools.

It is yet another objective of the present invention to provide a chain saw guard that is relatively easy to install and that does not prohibit or limit the cutting function.

It is yet still another objective of the present invention to provide a chain saw guard that is easy to operate and maintain and that will add little weight to the existing chain saw.

Various other objectives and advantages of the present invention become apparent to those skilled in the art as a more detailed description is set forth below.

SUMMARY OF THE INVENTION

A chain saw guard is provided that is adaptable to a number of portable chain saws types and includes a bracket, which is mounted to the motor housing, into which is slidably fitted a pair of cylindrically shaped longitudinal members extending above and below the chain saw blade. Rigidly affixed to the distal ends of the longitudinal members is a blade bridge, which is mounted perpendicular to the longitudinal members and which surrounds the blade. A coil spring is positioned over the upper longitudinal member between the housing bracket and blade bridge. In use, as when cutting through a tree trunk, the increased diameter of the trunk causes the blade bridge to be urged rearwardly along the blade and causes the longitudinal members to slide rearwardly through the bridge housing. During cutting, rearward movement of the blade bridge causes the resilient coil spring to compress. Once cutting is complete, or if the blade is otherwise removed from the tree trunk, the compressed spring rapidly urges the blade bridge forward, along the chain saw blade, until it returns to its original position. Thus, in the event of kick-back or other such accident, the blade bridge returns to its original position to allow the chain saw guard to provide protection from the cutting chain and to thus prevent possible injury to the user.

DESCRIPTION OF THE PREFERRED EMBODIMENT

Figure 1:
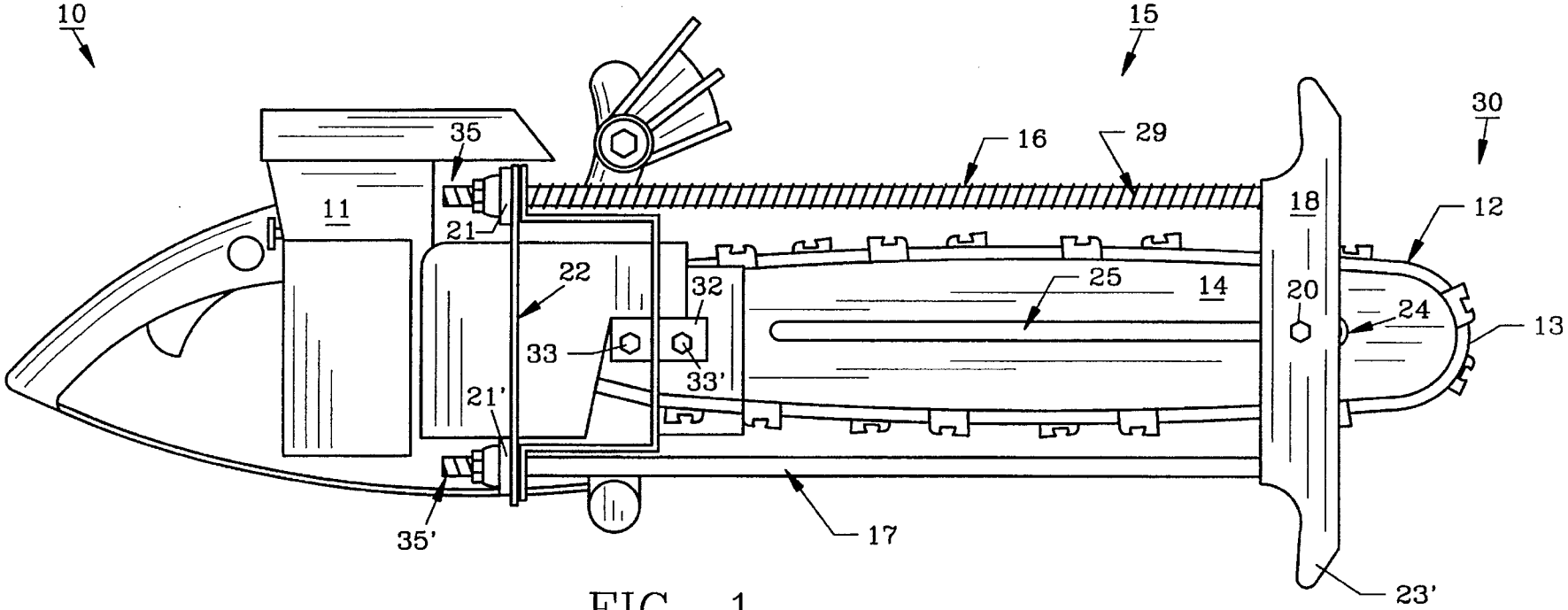
FIG. 1 demonstrates a side elevational view of a conventional portable chain saw modified to include the chain saw guard of the invention.
Figure 2:
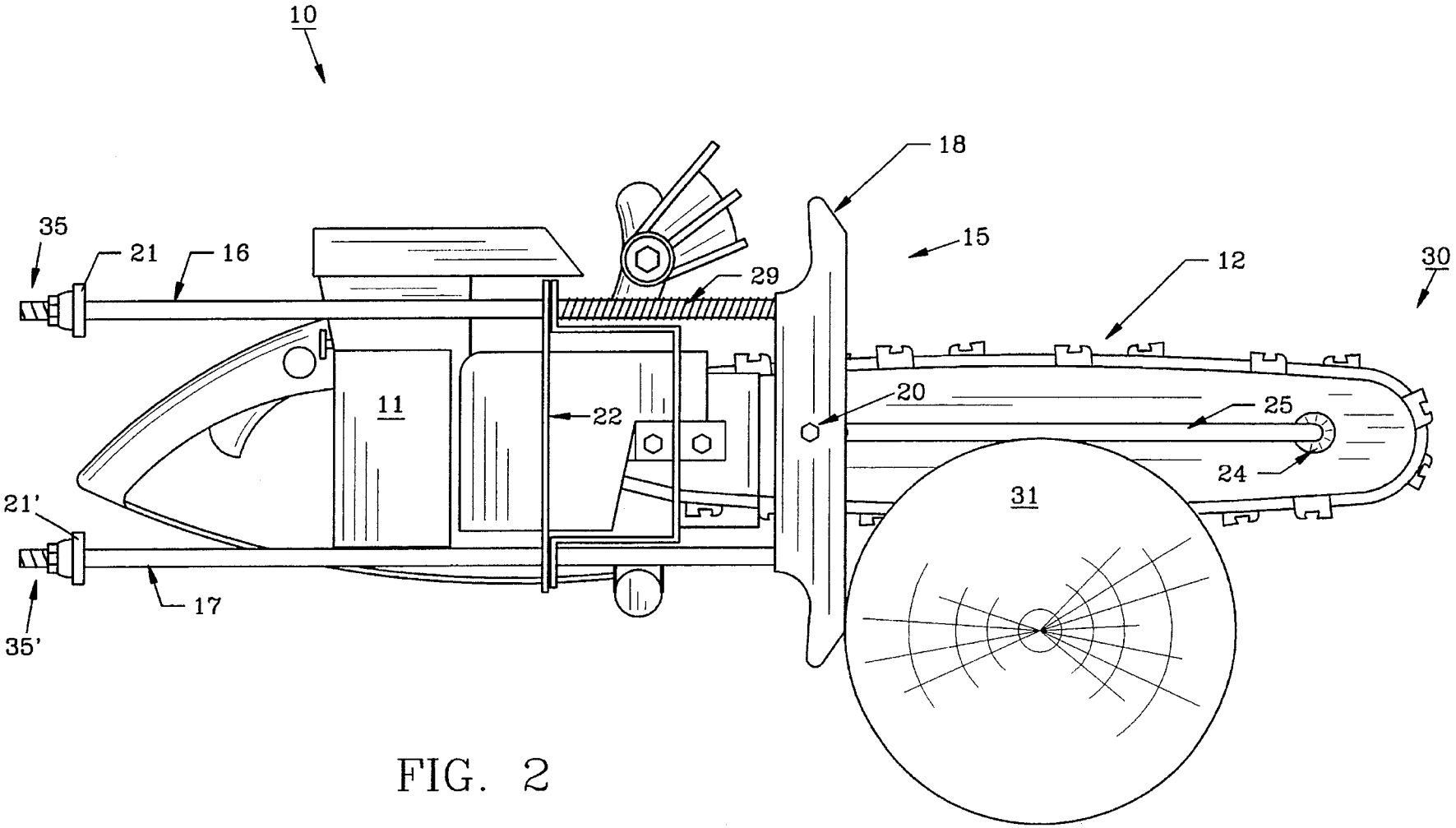
FIG. 2 shows a side elevational view of the chain saw and guard, as in FIG. 1, but with the blade bridge urged rearwardly, towards the motor housing, due to its contact with the tree trunk.
Figure 3:
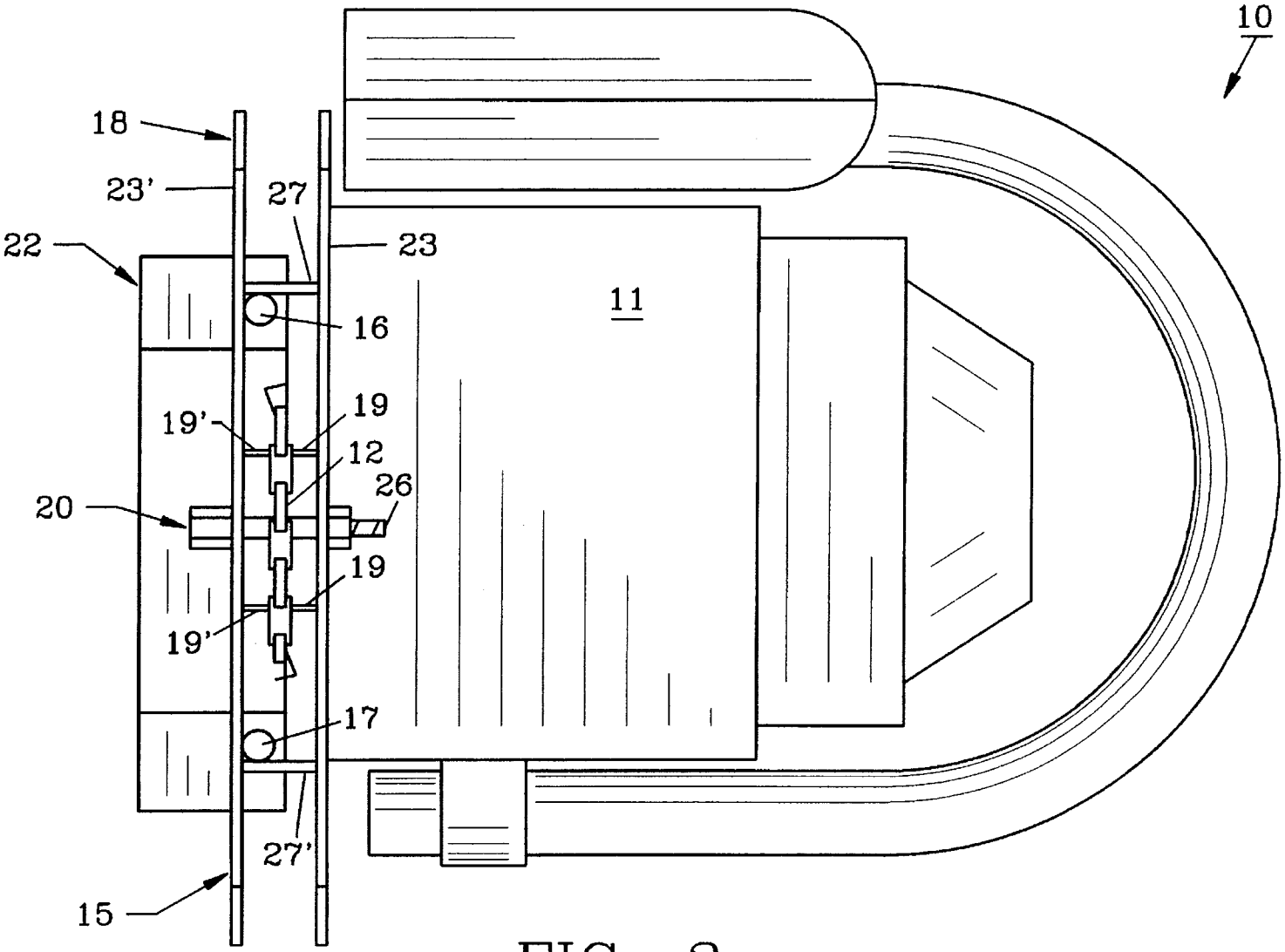
FIG. 3 illustrates an enlarged elevational view of the front end of the chain saw blade and guard, as depicted in FIG. 1.

The preferred form of the invention is shown in FIGS. 1–3 whereby a chain saw guard is formed from a durable metal such as steel or aluminum and includes a motor housing bracket for attaching to the chain saw motor housing. The bracket includes a pair of openings for slidably receiving a first, upper, cylindrically shaped, rigid longitudinal member and a second, lower, cylindrically shaped, rigid longitudinal member therein. A chain saw blade bridge is rigidly affixed at the distal ends of the longitudinal members and is mounted perpendicular thereto. The blade bridge comprises a vertical component that surrounds the chain saw blade and includes a plurality of blade bridge guides therein, which slide along the chain guide bar during operation. Also, a blade slot guide, which is cylindrically shaped, passes through a central longitudinal slot in the chain guide bar. At the forward of the guide bar slot a guide bar well is seen communicating with the guide bar slot to prevent accumulation of wood chips and debris, which can lodge in the guide bar slot during tree cutting. The well-shaped configuration allows the chips to be forced outwardly away from the guide bar as the blade bridge returns to its original position once the chain saw blade is removed when cutting is complete. Without the blade slot well, the slot guide may jam and not fully return to the distal end of the guide bar slot. The first and second longitudinal members provide protection from tree limbs or the like, which may contact the cutting chain during operation and cause the chain saw to jam.

DETAILED DESCRIPTION OF THE DRAWINGS AND OPERATION OF THE INVENTION

For a better understanding of the invention and its operation, turning now to the drawings, in FIG. 1 a conventional portable chain saw 10 is shown having a motor housing 11 and a chain saw blade 12 with cutting chain 13 thereon. As is standard in the trade, cutting chain 13 is positioned and slides along chain guide bar 14. Chain saw guard 15 is shown mounted on motor housing 11 by rectangular housing bracket 22, which includes rectangular tab 32 with bolts 33, 33'. Chain saw guard 15 includes first upper longitudinal member 16 and second longitudinal member 17, which are cylindrically shaped metal rods extending from bracket 22 to blade bridge 18. As seen in FIG. 1, blade bridge 18 is positioned near the distal end 30 of chain saw blade 12.

As shown in FIG. 3, blade bridge 18 includes a pair of vertical components 23, 23', which are positioned on either side of chain saw blade 12, and includes horizontal components 27, 27'. As further shown in FIG. 3, blade bridge 18 surrounds chain saw blade 12 and includes bridge guides 19, 19', which slide along blade guide bar 14 during movement. In an effort to further stabilize blade bridge 18, slot guide 20 is provided, which passes through guide bar slot 25, as shown in FIG. 1, and is tightenable by nut 26, as seen in FIG. 3.

During use, cutting begins with the tip or distal end 30 of chain saw blade 12 being placed atop a tree limb 31 or the like. As cutting proceeds, blade bridge 18 contacts tree limb 31 and is urged towards motor housing 11. As blade bridge 18 moves rearwardly, coil spring 29, shown on first longitudinal member 16, is compressed to its maximum position, as generally shown at FIG. 2. In the event chain saw 10 happens to "kick-back," as may occur, compressed spring 29 rapidly extends, urging blade bridge 18 to return to its original position near distal end 30 of chain saw blade 12 and thereby affording protection from cutting chain 13. A second coil spring could be placed on second longitudinal member 17 if additional return force is desired.

During cutting, wood chips and debris often collect in guide bar slot 25 and can prevent or retard the motion of bridge slot guide 20 as it moves along slot 25. To remedy this problem and to prevent jamming, blade slot well 24, as shown in FIGS. 1 and 2, is positioned at the distal end of guide bar slot 25 where it communicates with slot 25. Blade slot well 24 allows wood chips and other debris to easily exit slot 25 to prevent jamming.

As further shown in FIGS. 1 and 2, longitudinal members 16, 17 have stop members 21, 21' at their proximal ends 35, 35' respectively. Longitudinal stops 21, 21' are formed of a resilient material such as rubber to cushion the impact with bracket 22.

The illustrations and examples provided herein are for explanatory purposes and are not intended to limit the scope of the appended claims.

I claim:

1. A chain saw guard for attachment to a vertically planar chain guide bar having a longitudinally extending horizontal slot, said chain saw guard comprising: a blade bridge, said blade bridge having a left-side vertical component and an opposing right-side vertical component, a top horizontal component and an opposing bottom horizontal component, said left-side vertical component, said right-side vertical component, said top and said bottom horizontal components enclose said chain guide bar, a slot guide, said slot guide passes through said chain guide bar horizontal slot and is affixed to said left-side and said right-side vertical components, a first pair of bridge guides, said first pair of bridge guides protruding from said left-side vertical component into slidable contact with said chain guide bar, a second pair of bridge guides, said second pair of bridge guides protruding from said right-side vertical component into slidable contact with said chain guide bar, said first and said second pairs of bridge guides positioned vertically remote from said slot guide, wherein said blade bridge slides along a length of said chain guide bar horizontal slot with said blade bridge in alignment with said chain guide bar.

2. The chain saw guard of claim 1 wherein said left-side vertical component and said right-side vertical component are parallel to said vertically planar chain guide bar.

3. The chain saw guard of claim 1 wherein said first pair of bridge guides are positioned vertically remote from said slot guide with one of said bridge guides positioned above said slot guide and the other bridge guide positioned below said slot guide.

4. The chain saw guard of claim 1 wherein said first and said second pairs of bridge guides are narrow.

5. The chain saw guard of claim 1 wherein said first pair of bridge guides are normal to said left-side vertical component.

6. The chain saw guard of claim 5 wherein said first pair of bridge guides are normal to said chain guide bar.

7. A chain saw guard and a chain saw combination, said chain saw having a motor housing and a chain guide bar defining a horizontal slot, said combination comprising: a blade bridge, said blade bridge surrounding said chain guide bar, said blade bridge movable along said chain guide bar horizontal slot, a first pair of opposing narrow bridge guides, said bridge guides positioned on opposite sides of said chain guide bar, said bridge guides extending horizontally from said blade bridge towards said chain guide bar, wherein said bridge guides are vertically displaced remote from said horizontal slot of said chain guide bar.

8. The combination of claim 7 and including a first longitudinal member, said first longitudinal member attached to said blade bridge and slidably attached to said chain saw housing to bias said blade bridge movement along said chain guide bar horizontal slot.

9. The combination of claim 7 and including a second pair of opposingly positioned narrow bridge guides, said second pair of bridge guides extending horizontally from said blade bridge towards said chain guide bar, wherein said second pair of bridge guides are vertically displaced remote from said first pair of bridge guides and said chain guide bar horizontal slot.

10. The combination of claim 9 wherein said first pair of bridge guides are vertically displaced remotely above said chain guide bar horizontal slot and said second pair of bridge guides are vertically displaced remotely below said chain guide bar horizontal slot.

11. A chain saw guard and a chain saw combination, said chain saw having a motor housing and a chain guide bar defining a slot, said combination comprising: a blade bridge, said blade bridge surrounding said chain guide bar, said blade bridge movable along said chain guide bar, wherein said chain guide bar slot extends along a longitudinal axis of said chain guide bar, said chain guide bar defining a conically shaped well, said well communicating with said chain guide bar slot.

12. The combination of claim 11 and including a first longitudinal member, said first longitudinal member attached to said blade bridge and slidably attached to said chain saw housing to guide said blade bridge movement along said chain guide bar.

* * * * *